United States Patent [19]

Yeager

[11] Patent Number: 4,738,364

[45] Date of Patent: Apr. 19, 1988

[54] PORTABLE MEDICINE PROTECTOR

[75] Inventor: Steve Yeager, Redondo Beach, Calif.

[73] Assignee: Medicool, Inc., Torrance, Calif.

[21] Appl. No.: 29,740

[22] Filed: Mar. 24, 1987

[51] Int. Cl.[4] ..... F25D 3/08

[52] U.S. Cl. ..... 206/563; 206/555; 206/588; 62/457

[58] Field of Search ..... 62/457; 206/585, 586, 206/588, 589, 590, 562, 563, 564

[56] References Cited

U.S. PATENT DOCUMENTS

| | | | |
|---|---|---|---|
| 4,287,943 | 8/1981 | Hotta | 62/457 |
| 4,429,793 | 2/1984 | Ehmann | 62/457 |
| 4,438,637 | 3/1984 | Atkinson | 62/457 |
| 4,517,815 | 5/1985 | Basso | 62/457 |
| 4,530,220 | 7/1985 | Nambu et al. | 62/457 |
| 4,573,581 | 3/1986 | Galloway et al. | 62/457 |
| 4,580,412 | 4/1980 | Wells | 62/457 |
| 4,628,705 | 12/1986 | Navg | 62/457 |
| 4,662,188 | 5/1987 | Hullihan | 62/457 |

*Primary Examiner*—Joseph Man-Fu Moy
*Attorney, Agent, or Firm*—Blakely, Sokoloff, Taylor & Zafman

[57] ABSTRACT

A portable medicine protector for maintaining the temperature of medicine stored therein from rising above a threshold temperature and for preventing the temperature of medicine stored therein from falling below a second threshold temperature. The present invention consists of hollow walled container which has a cavity formed therein. The container is filled with a suitable liquid, (e.g. water, BLUE ICE, etc.) which may be frozen in an ordinary household freezer environment. A depression or cavity is formed in the container for receiving medicine, such as bottles of liquid medicine. The bottom and sides of the cavity include a plurality of ribbed members to prevent direct contact between a medicine bottle and the side walls of the container. By preventing point contact of the medicine with the side walls of the container, freezing of the medicine is inhibited and in most cases prevented. An outer casing consists of a sleeve of insulating material which in the preferred embodiment is pliable foam. The container is inserted into the case, with the case providing additional temperature protection and protection from shock and other trauma. Pockets or other storage areas may be included on the outside of the case for storing accessories such as syringes, alcohol wipes, swabs, etc.

7 Claims, 2 Drawing Sheets

Fig. 5
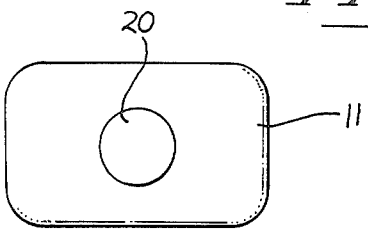
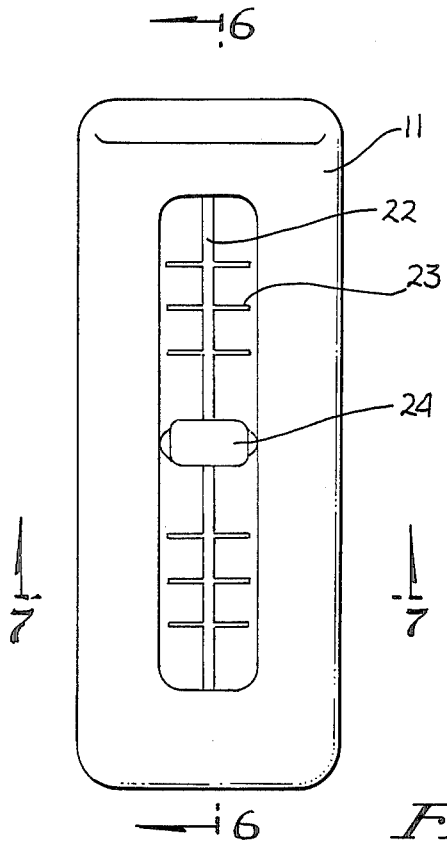
Fig. 4
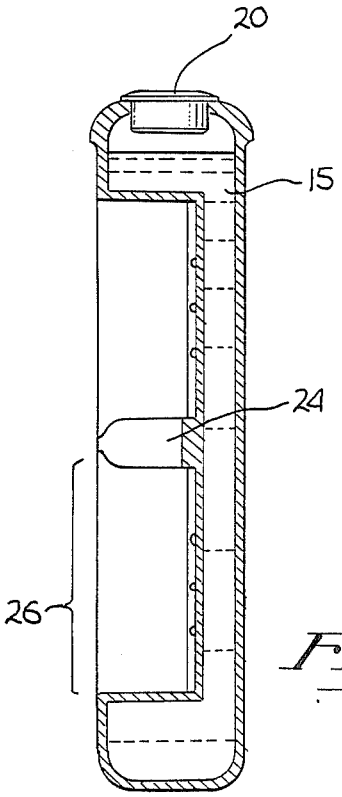
Fig. 6
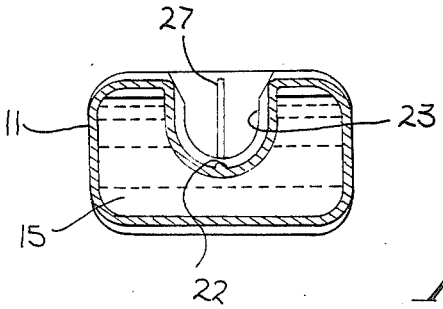
Fig. 7

PORTABLE MEDICINE PROTECTOR

FIELD OF THE INVENTION

This invention relates to the field of portable containers for transporting medicine and protecting it from environmental damage. In particular, the present invention is directed to a container for transporting liquid medicine in a temperature controlled environment.

BACKGROUND ART

There are certain physical conditions or ailments, such as diabetes, allergies, etc. that require regular applications of medication. In addition, it may also be required that certain counteractive agents be available should emergency situations arise. For example, a person who is allergic to wasp stings, must have access to medication in case of a wasp sting. In addition, regular and repeated applications of medication may be required, either taken orally or through injection. Persons with diabetes take insulin, by injection, in order to control blood sugar level. Other physical conditions may also require the repeated application or availability of medication either on a life long or temporary basis.

Many medications, however, are subject to rapid degradation of properties as a result of temperature and other environmental conditions. Other medications may be sensitive to light and still others may be sensitive to a combination of light and temperature. Further, many types of medication, particularly those taken by injection, are stored in glass bottles or vials which are subject to breakage if dropped or otherwise traumatized.

As a result, the mobility of those people requiring a constant availability of medication is severely restricted. For example, for one allergic to insect bites, medication must be administered within minutes and sometimes seconds after an insect bite to prevent severe complications or even death. Likewise, a diabetic must remain near a source of insulin in order to receive regular injections or an emergency injection should blood sugar level dictate. Therefore, it is desired to provide a means of storing medication such as wasp sting syrum and insulin along with means for administering it in a protective carrying case so that people who require medication may travel about with a supply of such medication.

However, insulin for example, like many other medications, must be kept cold, preferably at approximately 35 degrees fahrenheit, in order to maintain its effectiveness. Therefore, people who wish to travel about in warm temperature require some means of transporting insulin in a temperature controlled environment to maintain it at a desired temperature.

In addition, insulin manufacturers warn against freezing insulin. Therefore, it is desired to provide a means of transporting insulin in cold weather which will prevent it from reaching the freezing point. Thus, a portable medicine protector is desired to keep cool temperature in and keep cold temperatures out.

There have been a number of efforts in the prior art to provide a portable medicine protector for insulin and other medicines. For example, Taylor, U.S. Pat. No. 4,250,998, is directed to a diabetic travel kit comprising an outer insulated container and an inner container having a ring shaped chamber containing coolant. A compartment is provided in the ring shaped chamber for receiving an insulin bottle. The outer container is insulated to help maintain the temperature of the inner annular chamber.

Campbell, U.S. Pat. No. 4,343,158 discloses a portable pouch for storing insulin and syringes. The pouch includes a space filled with insulating material and a central space for inserting an ice pack for temperature control. Ehmann, U.S. Pat. No. 4,429,793 is directed to a diabetic traveling case comprising an insulated zippered case. A plastic container filled with liquid is frozen and inserted into the case. Containers of insulin are also inserted into the case next to the frozen container. Sheehan, et al U.S. Pat. No. 4,322,954 is directed to a portable medicine cooler which has an insulated compartment coupled by means of a heat sink to a second compartment filled with a frozen jell, ice or other coolant.

Although the above patents illustrate the recognized need for a portable medicine protector, none provide a storage environment which both protects from extremely high termperatures as well as extremely low temperatures.

Therefore, it is an object of the present invention to provide a portable medicine protector which will maintain medicine at a desired temperature.

It is another object of the present invention to provide a portable medicine protector which will prevent the temperature of the medicine from falling below a threshold level.

It is still another object of the present invention to provide a portable medicine protector which will protect medicine in medicine storage containers from shock and trauma.

It is yet another object of the present invention to provide a portable medicine protector which is compact and lightweight and may be easily carried.

SUMMARY OF THE PRESENT INVENTION

A portable medicine protector for maintaining the temperature of medicine stored therein from rising above a threshold temperature and for preventing the temperature of medicine stored therein from falling below a second threshold temperature is described. The present invention consists of a hollow walled container which has a cavity formed therein. The container is filled with a suitable liquid, (e.g. water, BLUE ICE, etc.) which may be frozen in an ordinary household freezer environment. A depression or cavity is formed in the container for receiving medicine, such as bottles of liquid medicine. The bottom and sides of the cavity include a plurality of ribbed members to prevent direct contact between a medicine bottle and the side walls of the container. By preventing point contact of the medicine with the side walls of the container, freezing of the medicine is inhibited and in most cases prevented. An outer casing consists of a sleeve of insulating material which in the preferred embodiment is pliable foam. The container is inserted into the case, with the case providing additional temperature protection and protection from shock and other trauma. Pockets or other storage areas may be included on the outside of the case for storing accessories such as syringes, alcohol wipes, swabs, etc.

BRIEF DESCRIPTION OF THE DRAWINGS

FIG. 4 is a plan view of the container of the present invention.

FIG. 5 is an end view of the container of FIG. 4.

FIG. 6 is a side view of the container of FIG. 4 taken along section lines 6—6.

FIG. 7 is an end view of the container of FIG. 4 taken along section lines 7—7.

DETAILED DESCRIPTION OF THE PRESENT INVENTION

A portable medicine protector is described. In the following description, numerous specific details are set forth, such as temperature limits, dimensions, etc. in order to provide a more thorough understanding of the present invention. It will be obvious, however, to those skilled in the art, that the present invention may be practiced without these specific details. In other instances, well known features have not been described in detail in order not to unnecessarily obscure the present invention.

In the following description, the present invention will be described in terms of storing bottles of insulin at a desired temperature. However, this is by way of example only, it being recognized that the present invention has equal application to other types and forms of medicine as well.

Figure 1:
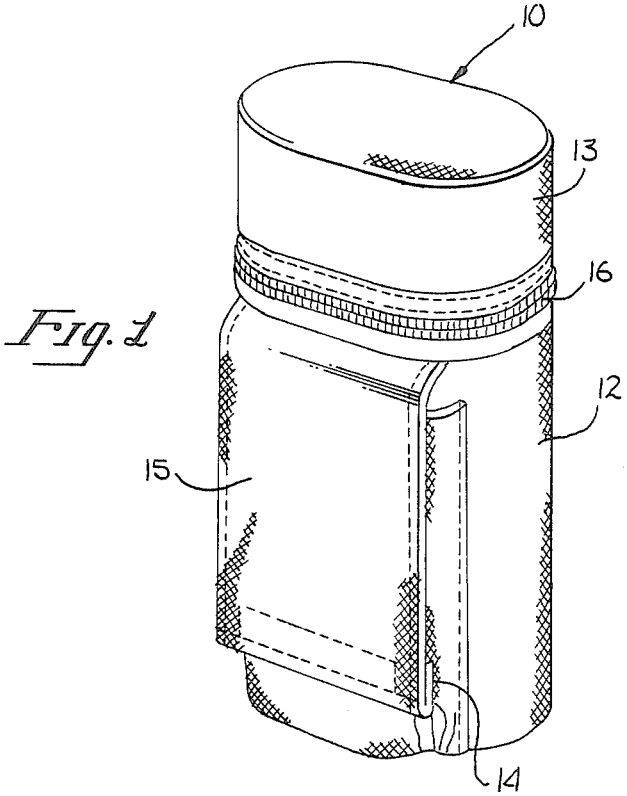
FIG. 1 is a perspective view of the outer case of the portable medicine protector of the present invention.
Figure 2:
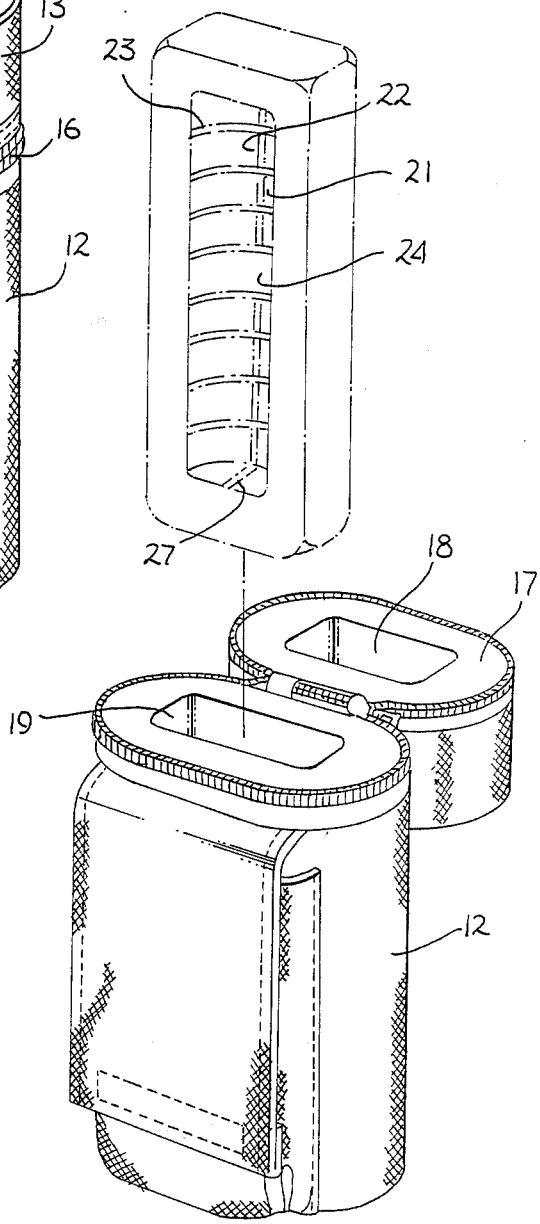
FIG. 2 is a perspective view showing the outer case in an open configuration and the hollow walled container for holding the medicine.

Referring now to FIGS. 1 and 2, the preferred embodiment of the present invention is illustrated. An outer case 10 is comprised of lower and upper sections 12 and 13 respectively. Sections 12 and 13 are joined by a zipper 16 in the preferred embodiment although any suitable means of joining the sections may be employed.

If desired, a pocket 14 may be formed on the outside of case 10 for storing syringes, slots, alcohol, and the like. A hingedly mounted flap 16 serves as a cover for the pocket. If desired, the flap and front face of the pocket may employ VELCRO strips for providing positive closure of the pocket.

Referring now to FIG. 2, the top section 13 of case 10 is hingedly mounted to bottom section 12. Both top section 13 and bottom section 12 are filled with insulating foam 17. The foam 17 in the preferred embodiment in the present invention is an insulating vinyl nitrile manufactured by Armstrong and sold under the name ARMAFLEX. The foam 17 is flexible and helps provide protection from shock and trauma to medicine stored in the present invention. Any suitable insulating material may be utilized which aids in the preservation of cold temperatures within the case 10 and also prevents the interior from the case 10 from freezing (i.e. has a low thermal conductivity).

The foam 17 has cavity 18 formed in top section 13 and cavity 19 formed in bottom section 12 of the case 10. Cavity 19 receives storage container 11. When storage container 11 is inserted into cavity 19, a portion of storage container 11 extends above the surface of the foam 17. When top section 13 is closed, container 11 extends into cavity 18.

In the preferred embodiment of the present invention, storage container 11 is a hollow walled polyethylene container. However, any material which may be made water tight and having a slight flexibility while still holding a desired shape may be employed. In operation, the hollow walled container 11 is filled with a liquid, such as water, BLUE ICE, or the like, which may be frozen. The container 11 is then placed in an ordinary household freezer and frozen at zero to ten degrees fahrenheit for approximtely seven hours. A cavity 21 is formed in the container 11 for receiving bottles of insulin and other medicine. The cavity 21 is semicircular in cross section and includes two compartments for medicine storage separated by divider 24. It has been found that direct contact between a medicine storage bottle and the side walls of the container 11 may result in the generation of localized "cold spots" in the medicine bottle which can result in crystallization and freezing of the insulin. Since insulin manufacturers warn against the freezing of insulin, it is desired to prevent this.

In the present invention, a central spine 22 is formed along the bottom of cavity 21 longitudinal to the container 11. Spine 22 is a solid strip of the material used to form the container 11. The spine 22 prevents direct contact between a medicine bottle and the bottom of cavity 21 of the container 11. In addition, a plurality of ribbed members 23 formed orthogonally to spine 22 prevent a medicine bottle from contacting the side walls of cavity 21. An end rib 27 formed at each end of cavity 21 prevents direct contact between the end of the cavity 21 and a medicine bottle stored therein.

It may not be necessary in all cases to provide ribs to prevent direct contact between medicine or a medicine storage container and the container 11 of the present invention. For example, if it is desired to store solid medicines in the container 11 of the present invention, no ribs are necessary. Further, if freezing is not a problem for certain liquid medicines, or if the freezing point of the liquid medicine is sufficiently below the recommended storage temperture of such medicine, no ribs are required. Therefore, the present invention is directed both to containers having ribs and those without ribs.

After freezing and insertion of one or more medicine bottles, the container 11 is placed into the outer case 10. The top section 13 is joined to bottom section 12 and closed as shown in FIG. 1. The stored medicine is now in a temperature controlled environment so that the insulin stored therein may be maintained in a desired temperature of approximately 35 degrees fahrenheit for extended periods of time. Thus, a diabetic may have a source of cool insulin always nearby for emergency use or for regular application.

Figure 3:
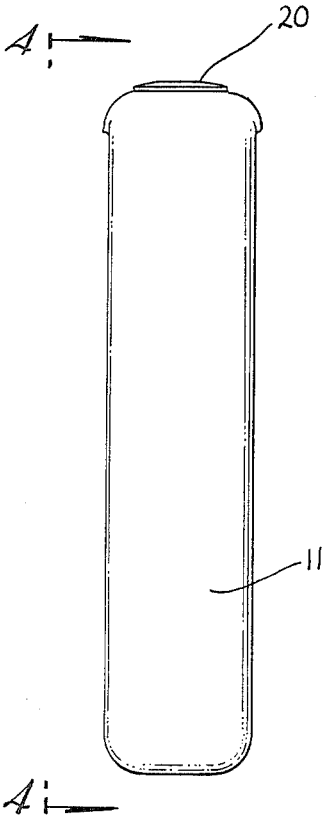
FIG. 3 is a side view of the container of the present invention.

A side view of the container 11 of the present invention is illustrated in FIG. 3. In the preferred embodiment of the present invention, the container 11 is substantialy rectangularly shaped in cross section. However, any suitable cross sectional shape may be utilized without departing from the scope of the present invention. A stopper 20 seals an opening in container 11 which is used to provide a freezing medium. In the preferred embodiment of the present invention, the stopper 20 is not removeable but may be if desired. Referring now to FIG. 5, an end view of the container 11 is shown. Stopper 20 is disposed approximately in the center of one end of the container 11 in the preferred embodiment of the present invention. However, the stopper 20 and corresponding opening may be formed wherever desired.

Referring to FIG. 6, a plan view of the container 11 is shown. In the preferred embodiment of the present invention, the dividing memeber 24 is substantially wider than the spine 22 or ribs 23 of the cavity 21 of the present invention. As can be seen, the spine 22 extends the length of cavity 21. Ribs 23 are shown as orthogonal to spine 22. However, this need not be the case and any suitable configuration of raised members formed in cavity 21 to prevent contact of a medicine bottle with the side walls of the cavity 21 may be utilized.

Referring to FIG. 6, in the preferred embodiment of the present invention, container 11 is not completely filled with freezing medium 25 so that upon freezing, expansion of the freezing medium will not force stopper 20 from container 11. The dimensions of cavity 21 and the placement of divider 24 are chosen so that the container 11 of the present invention will accept standard size medicine bottles. For example, the dimensions of the container 11 may be such as to allow acceptance of an insulin bottle manufactured by either ELI LILLY or SQUIBB NOVA.

Referring now to FIG. 7, we see that end rib 27 is formed so as to be approximately colinear with spine 22. Again, however, this is not a requirement but is illustrated as being the preferred embodiment only of the present invention. Any configuration of end ribs so as to prevent direct contact between a medicine bottle and the ends of cavity 21 may be utilized.

The present invention has been found to maintain insulin at a temperature of between 35 degrees and 40 degrees fahrenheit for approximtely seven hours when the ambient temperature is approximately 80 degrees fahrenheit. Thus, utilizing the present invention, a diabetic may have extended periods away from a conventional cooling source while still maintaining access to fresh insulin.

The medicine protector of the present invention also protects insulin from freezing in cold weather. It has been found that if an insulin bottle is placed in an unfrozen container 11 and stored in the outer case 10, the insulin will be protected from freezing for approximately five hours even though the ambient temperature is approximately zero degrees fahrenheit.

In the present application, "freezing" does not refer to any specific temperature but is used to indicate the point of transition from liquid state to solid state. A variety of liquids may be utilized in the container 11, having a variety of "freezing" points. The desired storage temperature of the medicine dictates the liquid used and the corresponding freezing point.

Thus, a medicine protector which maintains medicine at a desired temperature has been described.

I claim:

1. A medicine protector comprising:

a first hollow walled container having a cavity formed therein, said first container containing a medium which may be frozen at a desired temperature, said cavity for receiving and retaining medicine stored in a second container;

a plurality of solid ribbed members disposed transversely in said cavity, said ribbed members for preventing direct contact between said second container and said first container;

an outer case having at least two removably coupled sections, each of said sections containing insulating material resistent to thermal conductivity and to shock, said sections for receiving said first container such that said sections may be coupled together to enclose said first container;

whereby said protector may store medicine in a temperature and shock controlled environment.

2. The medicine protector of claim 1 wherein said insulating material comprises flexible foam.

3. The medicine protector of claim 1 wherein said insulating material comprises ARMALFLEX.

4. The medicine protector of claim 1 wherein said outer case further includes at least one pocket formed on at least one of said sections, said pocket for storing accessories for said medicine.

5. The medicine protector of claim 1 said wherein medium comprises water.

6. The medicine protector of claim 1 wherein said medium comprises BLUE ICE.

7. The medicine protector of claim 1 wherein said medicine comprises insulin.

* * * * *